US006467444B2

(12) United States Patent
Tanaka et al.

(10) Patent No.: US 6,467,444 B2
(45) Date of Patent: Oct. 22, 2002

(54) VALVE OPERATING SYSTEM IN INTERNAL COMBUSTION ENGINE

(75) Inventors: Chikara Tanaka; Noriyuki Yamada; Junichi Iwamoto, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/761,107

(22) Filed: Jan. 17, 2001

(65) Prior Publication Data

US 2001/0020457 A1 Sep. 13, 2001

(30) Foreign Application Priority Data

Jan. 18, 2000 (JP) ..... 2000-013917

(51) Int. Cl.[7] ..... F01L 13/00; F01L 1/18

(52) U.S. Cl. ..... 123/90.16; 123/90.39; 123/90.42; 123/90.44

(58) Field of Search ..... 123/90.15, 90.16, 123/90.39, 90.41, 90.42, 90.44; 74/519, 559

(56) References Cited

U.S. PATENT DOCUMENTS 5,460,130 A * 10/1995 Fukuzawa et al. ..... 123/90.16
5,553,584 A * 9/1996 Konno ..... 123/90.16
5,845,614 A * 12/1998 Tanaka et al. ..... 123/90.16
5,960,754 A * 10/1999 Sugimoto et al. ..... 123/90.15
5,979,379 A * 11/1999 Sato et al. ..... 123/90.16
6,186,102 B1 * 2/2001 Kosuge et al. ..... 123/90.16

FOREIGN PATENT DOCUMENTS

| | | |
|---|---|---|
| EP | 0 267 696 | 5/1988 |
| EP | 1 113 149 | 7/2001 |
| EP | 1 113 151 | 7/2001 |
| JP | 11-13440 | 1/1999 |

* cited by examiner

*Primary Examiner*—Weilun Lo
(74) *Attorney, Agent, or Firm*—Armstrong, Westerman & Hattori, LLP

(57) ABSTRACT

A valve operating system in an internal combustion engine includes an associative-operation switchover means capable of switching over the associative operation of a pair of rocker arms disposed adjacent each other and the releasing of the associative-operation. The associative-operation switchover means is provided between a plurality of rocker arms including the rocker arms disposed adjacent each other. In such valve operating system, through-bores are coaxially provided in support walls of the rocker arm, and opposite ends of a roller shaft are fitted and fixed in the through-bores. A spring-receiving member is mounted to the roller shaft for receiving a return spring. Thus, when the roller shaft with the return spring of the associative-operation switchover means accommodated therein is mounted to the rocker arm, it is possible to facilitate the processing and to reduce the size and weight of the rocker arm.

10 Claims, 10 Drawing Sheets

VALVE OPERATING SYSTEM IN INTERNAL COMBUSTION ENGINE

BACKGROUND OF THE INVENTION

1. Field of the Invention

The present invention relates to a valve operating system in an internal combustion engine, in which an associative operation switchover means capable of switching over the associative operation of a pair of rocker arms disposed adjacent each other and the releasing of the associative operation is provided between a plurality of rocker arms including the rocker arms disposed adjacent each other.

2. Description of the Related Art

Such valve operating systems are conventionally known from Japanese Patent Application Laid-open Nos. 11-13440 and 2-102304 and the like, for example.

In the valve operating system disclosed in the above Japanese Patent Application Laid-open No. 11-13440, a bottomed hole, in which one end of a roller shaft is fitted and fixed, is provided in one of a pair of support walls included in one of a plurality of the rocker arms, which one rocker arm is disposed at one end in the direction of arrangement of the rocker arms, and a through-bore, in which the other end of the roller shaft is fitted and fixed, is provided in the other support wall, with a return spring accommodated in the roller shaft being received at a closed end of the bottomed hole. However, in providing the bottomed hole in the one support wall by drilling, the closed end of the bottomed hole must be subjected to a relieving treatment and hence, the drilling is complicated. Moreover, the size of the rocker arm must be increased by an amount corresponding to the relieving treatment, and the weight of the rocker arm is increased by an amount corresponding to an end wall of the bottomed hole remaining there.

In the valve operating system disclosed in the above Japanese Patent Application Laid-open No. 2-102304, a bottomed hole, in which a limiting member is slidably fitted, is provided in one of a plurality of rocker arms, which is disposed at one end in the direction of arrangement of the rocker arms, and a return spring is mounted between a closed end of the bottomed hole and the limiting member. However, in providing the bottomed hole in the rocker arm by drilling, the closed end of the bottomed hole must be subjected to a relieving treatment and hence, the drilling is complicated. Moreover, the size of the rocker arm must be increased by an amount corresponding to the relieving treatment, and the weight of the rocker arm is increased by an amount corresponding to an end wall of the bottomed hole remaining there.

SUMMARY OF THE INVENTION

Accordingly, it is an object of the present invention to provide a valve operating system in an internal combustion engine, wherein in accommodating the return spring of the associative-operation switchover means, the processing or treatment therefore is facilitated, and reductions in size and weight of the rocker arm are provided.

To achieve the above object, according to a first aspect and feature of the present invention, there is provided a valve operating system in an internal combustion engine, comprising a first rocker arm having a pair of support walls which support a cylindrical roller shaft at opposite ends thereof, the roller shaft rotatably carrying a roller mounted in rolling contact with a cam provided on a camshaft, the support walls being disposed on opposite sides of the roller, a second rocker arm disposed adjacent the first rocker arm, and an associative-operation switchover means including a switchover pin which is movable between an associatively operating position where the first and second rocker arms are operated in association with each other and an associative-operation releasing position where the switchover pin is separated from the first rocker arm to release the associative operation, the switchover pin being capable of transmitting a hydraulic pressure force acting toward the associatively operating position, a limiting member which is slidably received in the roller shaft in the first rocker arm to abut against the switchover pin, and a coiled return spring accommodated in the roller shaft to exhibit a spring force for biasing the switchover pin toward the associative-operation releasing position, the associative-operation switchover means being provided between a plurality of rocker arms including the first and second rocker arms, wherein the support walls have through-bores coaxially provided therein, in which opposite ends of the roller shaft are fitted and fixed, and a spring-receiving member is mounted to the roller shaft for receiving the return spring which is interposed between the spring-receiving member and the limiting member.

With such arrangement of the first feature, the through-bores are provided in the pair of support walls. Therefore, as compared with the prior art system in which the bottomed hole must be provided by drilling, a relieving treatment is not required, whereby the drilling of the support walls can be facilitated, while enabling a reduction in size of the rocker arms and moreover, the weight of the rocker arms can be reduced by an amount corresponding to the unnecessary end wall.

According to a second aspect and feature of the present invention, in addition to the first feature, a snap ring is detachably mounted to an inner surface of the roller shaft, and the spring-receiving member is ring-shaped, thinner than the snap ring and engaged with the snap ring from an axial inside of the roller shaft. With such arrangement of the second feature, it is easy to mount the spring-receiving member to the roller shaft and further, the spring-receiving member can be formed thinner than the snap ring, whereby the weight of the spring-receiving member can be reduced to contribute to a reduction in weight of the entire rocker arm. Moreover, it can be ascertained from the outside through the ring-shaped spring-receiving member whether the return spring has been accommodated correctly in the roller shaft.

According to a third aspect and feature of the present invention, in addition to the first feature, a driving rocker arm included in the plurality of rocker arms and operatively connected to an engine valve has a roller-accommodating bore provided therein to open vertically, the roller-accommodating bore having a pair of surfaces opposed to an outer peripheral surface of the roller mounted in rolling contact with the cam, the roller being accommodated in the roller-accommodating bore, the roller-accommodating bore being formed to have an area of an opening at a lower end thereof smaller than that at an upper end thereof, with each of the opposed surfaces being comprised of a curved surface portion which is formed to extend between an upper surface of the driving rocker arm and a preset point spaced upwards from a lower surface of the driving rocker arm, the curved surface portion being curved into a circular shape concentric with the roller, an extended surface portion connected at one end thereof to a lower end of the curved surface portion and extending toward the outer peripheral surface of the roller, and a lower surface portion which interconnects the other end of the extended surface portion and the lower surface of the rocker arm and is opposed to a lower portion of the outer peripheral surface of the roller.

With such arrangement of the third feature, by provision of the extended surface portion and the lower surface portion, the thickness of the driving rocker arm at the lower portion of the roller-accommodating bore can be ensured at such a level that a reduction in rigidity can be prevented. Moreover, by forming the extended surface portion to extend from the lower end of the curved surface portion toward the outer peripheral surface of the roller, the lower portion of the surface opposed to the outer peripheral surface of the roller can be disposed at a location closer to the roller to reduce the area of the opening of the lower end of the roller-accommodating bore, thereby enhancing the ability to retain the oil between the opposed surfaces of the roller-accommodating bore and the roller, as compared with a case where the surface opposed to the outer peripheral surface of the roller is formed at a uniform radius of curvature between the upper and lower surfaces of the driving rocker arm.

According to a fourth aspect and feature of the present invention, in addition to the first feature, a driving rocker arm included in the plurality of rocker arms and operatively connected to an engine valve has a roller-accommodating bore provided therein to open vertically, the roller-accommodating bore having a pair of surfaces opposed to an outer peripheral surface of the roller mounted in rolling contact with the cam, the roller being accommodated in the roller-accommodating bore, an opening edge at the lower end of the roller-accommodating bore being comprised of a pair of parallel portions parallel to each other and corresponding to the opposite side surfaces of the roller, and a pair of curved portions which are opposed to the outer peripheral surface of the lower portion of the roller and interconnect the parallel portions, the curved portions being bulged on a side opposite from the outer peripheral surface of the lower portion of the roller, opposite ends of the curved portions being smoothly connected to the parallel portions.

With such arrangement of the fourth feature, a stress concentration can be prevented from being produced in a connection between the parallel portion which is a portion opposed to the side surface of the roller and the curved portion which is a portion opposed to the outer peripheral surface of the roller in the opening edge at the lower end of the roller-accommodating bore, thereby contributing to an enhancement in durability of the driving rocker arm.

According to a fifth aspect and feature of the present invention, there is provided a valve operating system in an internal combustion engine, comprising an associative-operation switchover means including a switchover pin which is movable between an associatively operating position where the switchover pin is located astride first and second rocker arms disposed adjacent each other to permit the first and second rocker arms to be operated in association with each other and an associative-operation releasing position where the switchover pin is separated from the first rocker arm to release the associative operation, the switchover pin being capable of transmitting a hydraulic pressure force acting toward the associatively operating position, a limiting member which is slidably received in the first rocker arm to abut against the switchover pin, and a coiled return spring accommodated in the first rocker arm to exhibit a spring force for biasing the switchover pin toward the associative-operation releasing position, the associative-operation switchover means being provided between a plurality of rocker arms including the first and second rocker arms, wherein the first rocker arm is provided with a through-bore in which the limiting member is slidably fitted; a snap ring is detachably mounted to an inner surface of an outer end of the through-bore; and a ring-shaped spring-receiving member thinner than the snap ring is engaged with the snap ring from an axial inside of the through-bore, the return spring being mounted between the limiting member and the spring-receiving member.

With such arrangement of the fifth feature, the snap ring engaged with the outer surface of the ring-shaped spring-receiving member inserted in the through-bore is detachably mounted to the inner surface of the outer end of the through-bore. Therefore, as compared with the prior art system in which the bottomed hole must be provided by drilling, a relieving treatment is not required, whereby the drilling of the rocker arm can be facilitated, while enabling a reduction in size of the rocker arm and moreover, the weight of the rocker arm can be reduced by an amount corresponding to the unnecessity of an end wall. In addition, it is easy to mount the spring-receiving member in the through-bore and further, the spring-receiving member can be formed thinner than the snap ring, whereby the weight of the spring-receiving member can be reduced to contribute to a reduction in weight of the entire rocker arm. Moreover, it can be ascertained from the outside through the ring-shaped spring-receiving member whether the return spring has been accommodated correctly in the roller shaft.

The above and other objects, features and advantages of the invention will become apparent from the following description of the preferred embodiments taken in conjunction with the accompanying drawings.

BRIEF DESCRIPTION OF THE DRAWINGS

FIGS. 1 to 7 show a first embodiment of the present invention, wherein

FIG. 1 is a vertical sectional view of a portion of an internal combustion engine;

FIG. 2 is a plan view taken in the direction of an arrow 2 in FIG. 1;

FIG. 3 is an enlarged view taken along a line 3—3 in FIG. 1;

FIG. 4 is a sectional view taken along a line 4—4 in FIG. 3;

FIG. 5 is an enlarged sectional view taken along a line 5—5 in FIG. 1;

FIG. 6 is an enlarged sectional view taken along a line 6—6 in FIG. 3;

FIG. 7 is a sectional view for explaining a press-fit margin for a roller shaft press-fitted into a rocker arm;

DESCRIPTION OF THE PREFERRED EMBODIMENTS

Figure 1:
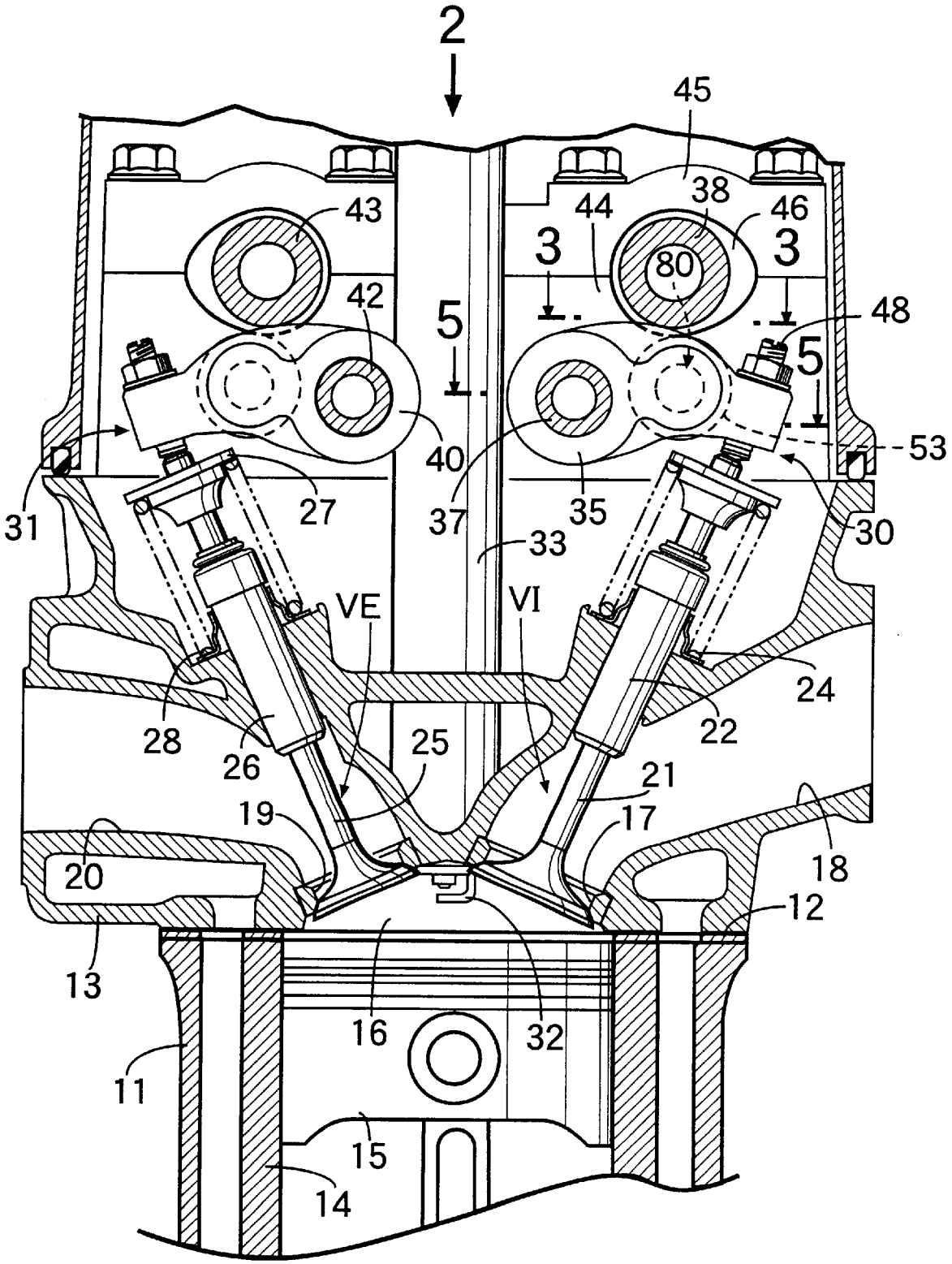
Figure 2:
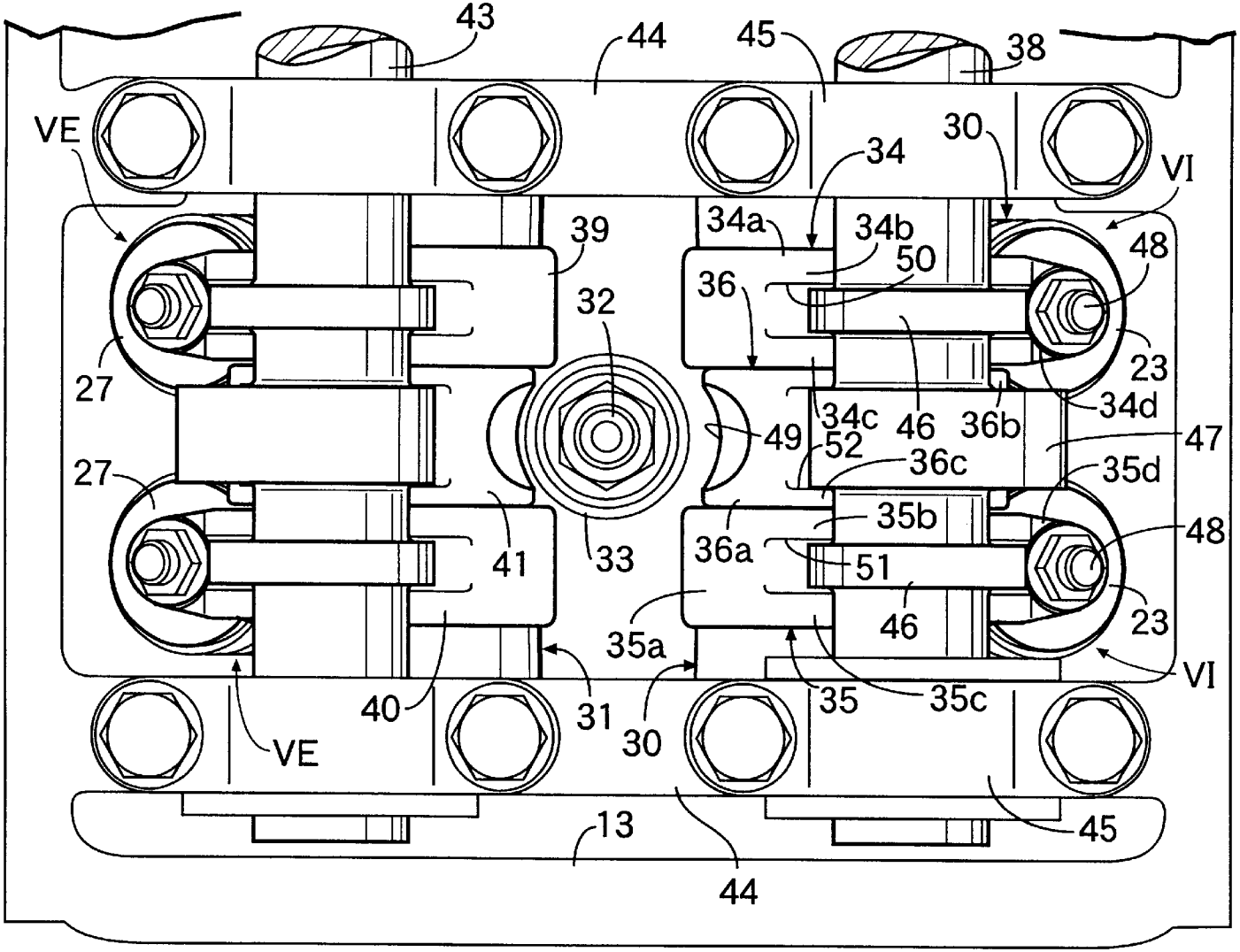

The present invention will be described by way of a first embodiment with reference to FIGS. 1 to 7. Referring first to FIGS. 1 and 2, a multi-cylinder internal combustion engine includes a cylinder block 11, and a cylinder head 13 coupled to an upper portion of the cylinder block 11 through a gasket 12. A piston 15 is slidably received in each of cylinders 14 provided in the cylinder block 11. A combustion chamber 16 is defined in every cylinder by the cylinder block 11, the cylinder head 13 and each of the pistons 15.

Provided in the cylinder head 13 for every cylinder are a pair of intake valve bores 17 facing one side of a ceiling surface of the combustion chamber 16, an intake port 18 which is connected commonly to the intake valve bores 17 and opens into one side surface of the cylinder head 13 (a right side surface as viewed in FIG. 1), a pair of exhaust valve bores 19 facing the other side of the ceiling surface of the combustion chamber 16, and an exhaust port 20 which is connected commonly to the exhaust valve bores 19 and opens into the other side surface (a left side surface as viewed in FIG. 1) of the cylinder head 13.

Stems 21 of intake valves VI, VI capable of opening and closing the intake valve bores 17, respectively, are slidably received in guide tubes 22 mounted in the cylinder head 13, and valve springs 24 for biasing the intake valves VI, VI upwards, i.e., in a valve closing direction are mounted between the cylinder head 13 and retainers 23, 23 mounted at upper ends of the stems 21 protruding upwards from the guide tubes 22. Stems 25 of exhaust valves VE, VE capable of opening and closing the exhaust valve bores 19, respectively, are slidably received in guide tubes 26 mounted in the cylinder head 13, and valve springs 28 for biasing the exhaust valves VE, VE upwards, i.e., in a valve closing direction are mounted between the cylinder head 13 and retainers 27, 27 mounted at upper ends of the stems 25 protruding upwards from the guide tubes 26.

The intake valves VI, VI are opened and closed by an intake-side valve operating device 30, and the exhaust valves VE, VE are opened and closed by an exhaust-side valve operating device 31. A plug insertion tube 33 is disposed between both of the valve operating devices 30 and 31 to extend vertically for insertion of a spark plug 32 mounted in the cylinder head 13 to face the central portion of the combustion chamber 16, and is attached at its lower end to the cylinder head 13.

The intake-side valve operating device 30 includes a driving rocker arm 34 as a first rocker arm corresponding to one of the pair of intake valves VI, VI, a driving rocker arm 35 corresponding to the other of the pair of intake valves VI, VI, a free rocker arm 36 as a second rocker arm capable of being freed relative to the driving rocker arms 34 and 35, i.e., the intake valves VI, VI, an intake-side rocker shaft 37 on which the rocker arms 34, 35 and 36 are supported swingably, and an intake-side camshaft 38 rotatable about an axis parallel to the rocker shaft 37.

The exhaust-side valve operating device 31 includes a pair of driving rocker arms 39 and 40 individually corresponding to the pair of exhaust valves VE, VE, a free rocker arm 41 capable of being freed relative to the driving rocker arms 39 and 40, i.e., the exhaust valves VE, VE, an exhaust-side rocker shaft 42 on which the rocker arms 39, 40 and 41 are supported swingably, and an exhaust-side camshaft 43 rotatable about an axis parallel to the rocker shaft 42.

The intake-side and exhaust-side rocker shafts 37 and 42 are fixedly supported by holder walls 44 provided on the cylinder head 13 between the adjacent cylinders. The intake-side and exhaust-side camshafts 38 and 43 are operatively connected at a reduction ratio of 1/2 to a crankshaft (not shown) and rotatably supported by the holder walls 44 and cam holders 45 fastened to upper ends of the holder walls 44.

The intake-side and exhaust-side valve operating devices 30 and 31 have basically the same construction and hence, the construction and operation of the intake-side valve operating device will be described in detail, and the description of the exhaust-side valve operating device 31 is omitted.

Provided on the intake-side camshaft 38 are a high-speed cam 47, and low-speed cams 46, 46 disposed on opposite sides of the high-speed cam 47 in correspondence to the intake valves VI, respectively.

Figure 3:
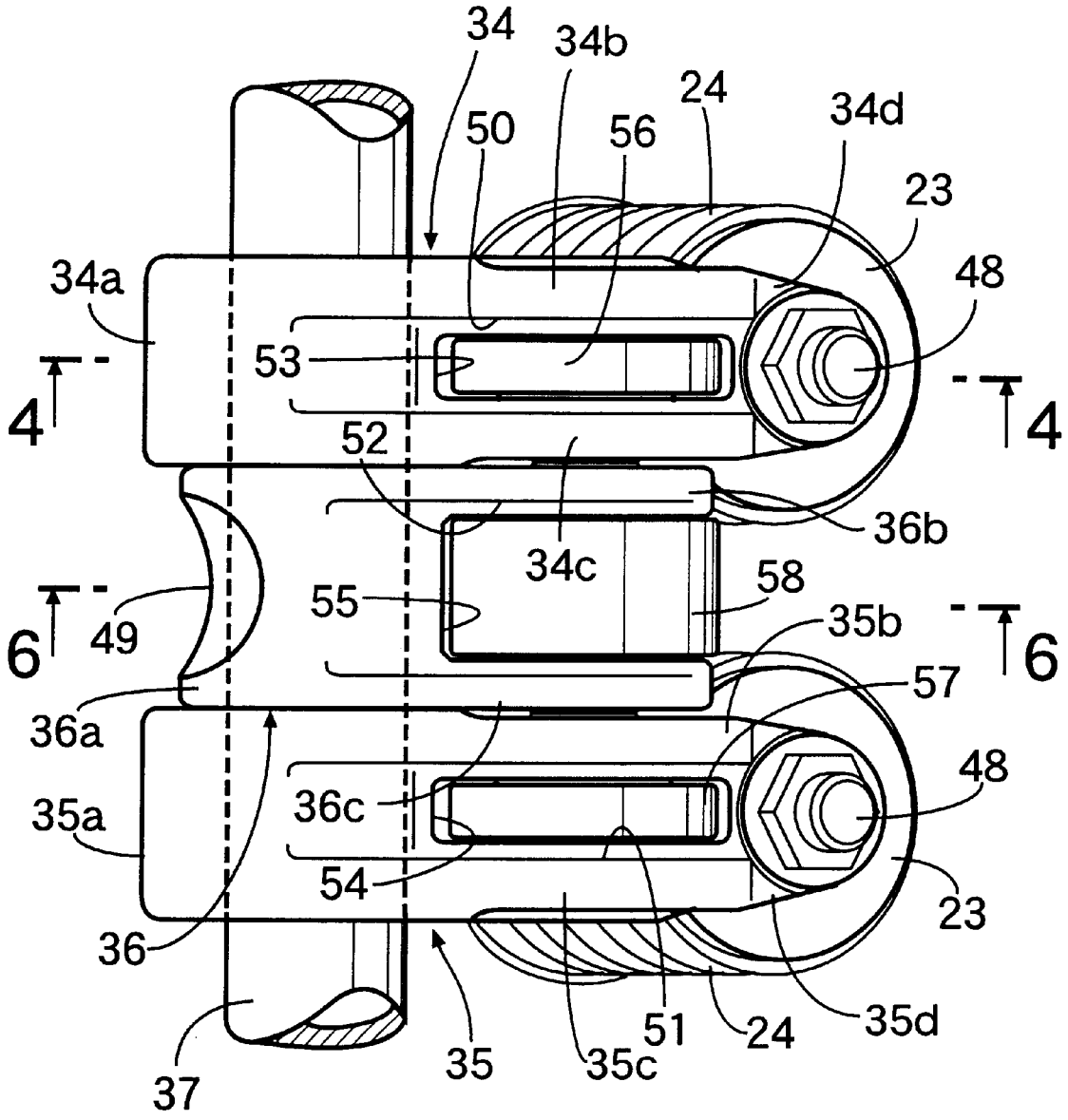

Referring to FIG. 3, the driving rocker arms 34 and 35 and the free rocker arm 36 are formed of an aluminum alloy, for example, for the purpose of providing a reduction in weight, with their surfaces subjected to an anodizing treatment, and are disposed adjacent one another in such a manner that the free rocker arm 36 is sandwiched between the driving rocker arms 34 and 35, and further, they are swingably supported commonly on the intake-side rocker shaft 37.

Each of the driving rocker arms 34 and 35 and the free rocker arm 36 includes a cylindrical swinging support portion 34*a*, 35*a*, 36*a* swingably carried on the intake-side rocker shaft 37 at a base end thereof, and first and second support walls 34*b*, 34*c*; 35*b*, 35*c*; 36*b*, 36*c* which are opposed to each other and provided at locations spaced apart from each other in a direction along an axis of the intake-side rocker shaft 37 to extend from the swinging support portion 34*a*, 35*a*, 36*a*. Tip ends of the first and second support walls 34*b*, 34*c*; 35*b*, 35*c* of the driving rocker arms 34 and 35 are connected to each other by connecting portions 34*d* and 35*d*, respectively.

Figure 4:
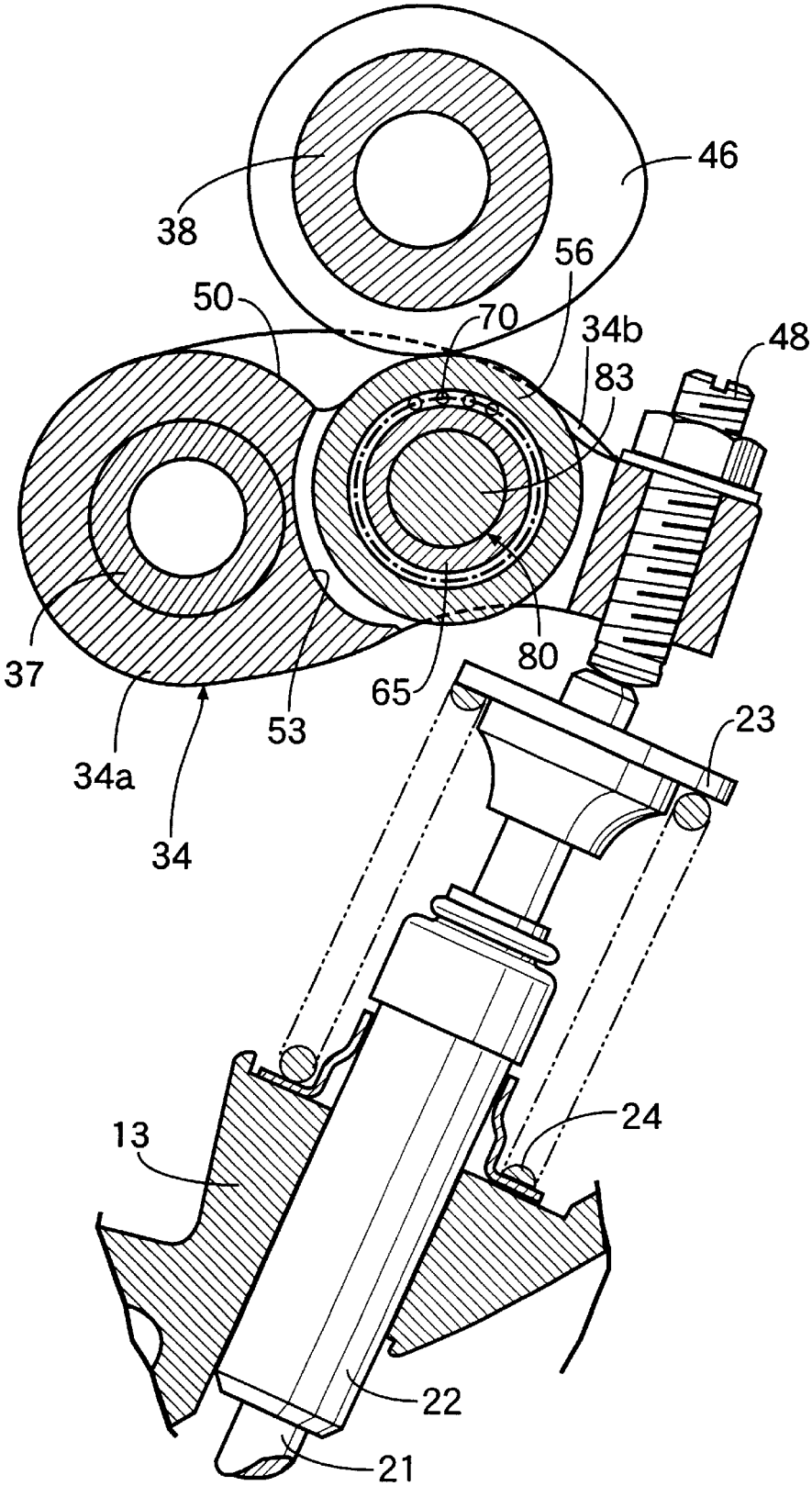

Referring also to FIG. 4, tappet screws 48, 48 are threadedly fitted for advancing and retracting movements into the connections 34*d* and 35*d* at the tip ends of the driving rocker arms 34 and 35 to abut against the upper ends of the stems 21 of the intake valves VI, VI.

An arcuate notch 49 is provided in a portion of the swinging support portion 36*a* of the free rocker arm 36 corresponding to the plug insertion tube 33 so as to be recessed on a side opposite from the plug insertion tube 33, in order to enable the plug insertion tube 33 to be disposed in proximity to the free rocker arm 36.

Figure 5:
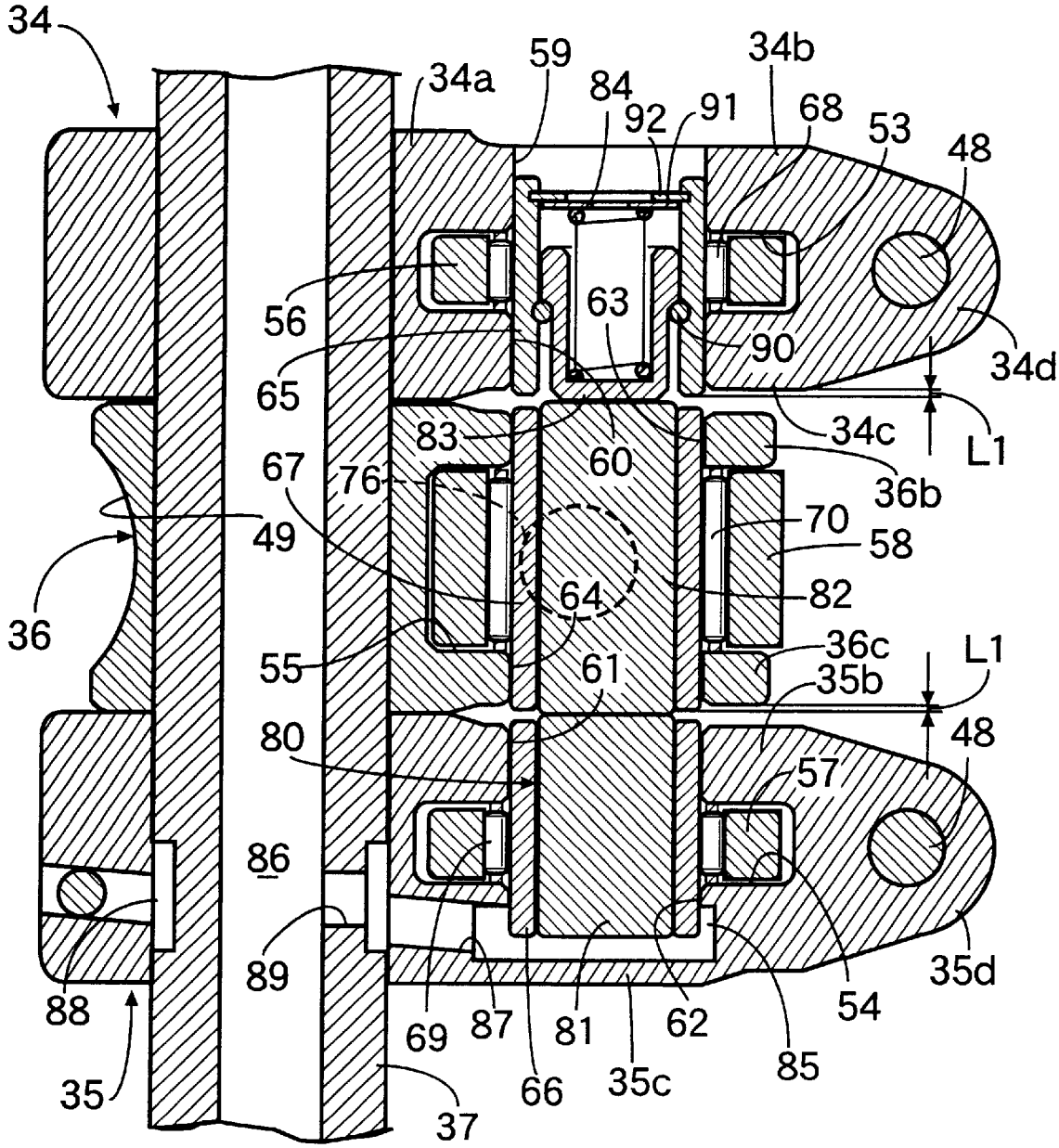
Figure 6:
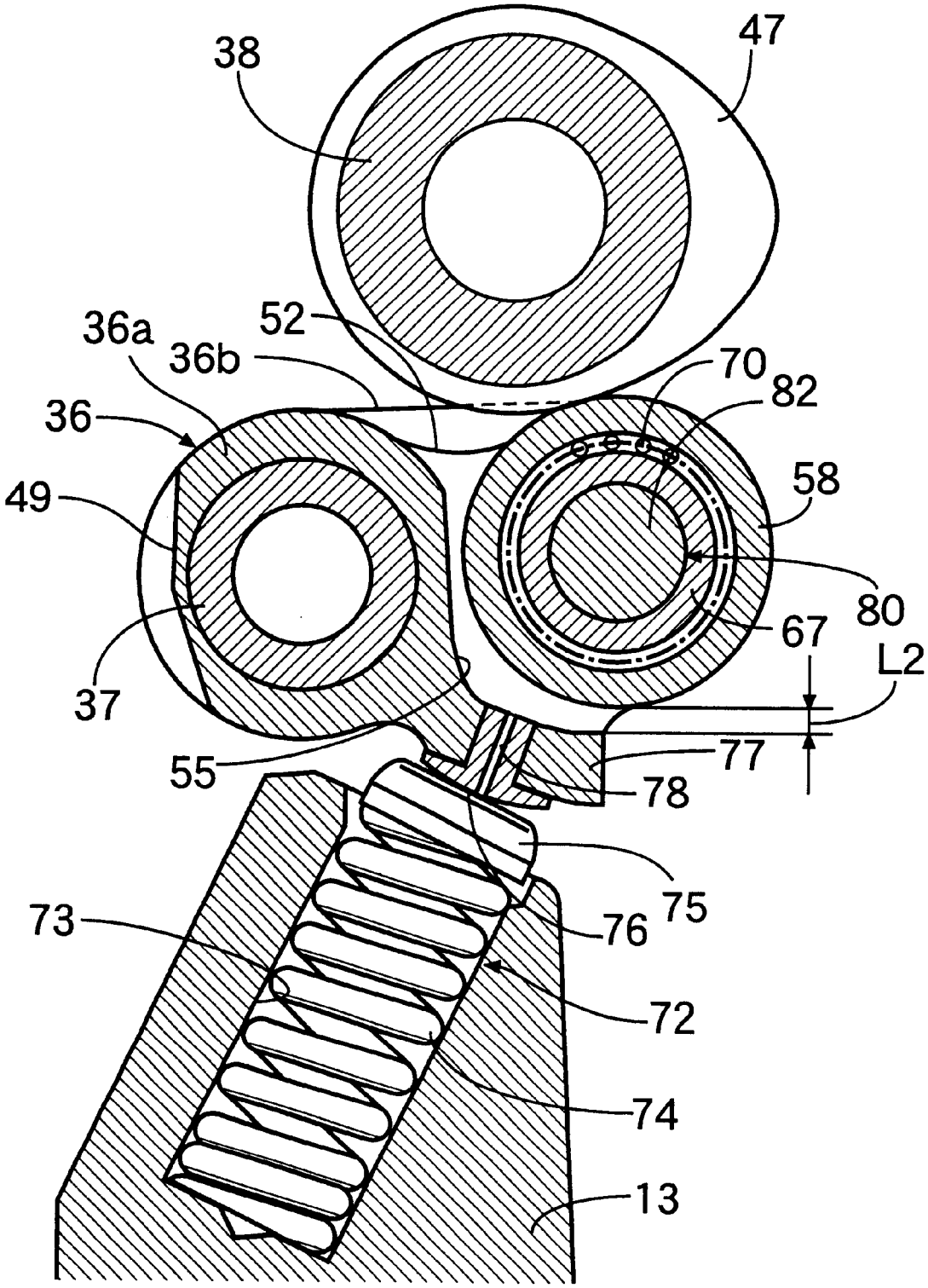

Referring also to FIGS. 5 and 6, a recess 50 is defined between the support walls 34*b* and 34*c* on the upper surface of the driving rocker arm 34; a recess 51 is defined between the support walls 35*b* and 35*c* on the upper surface of the driving rocker arm 35, and a recess 52 is defined between the support walls 36*b* and 36*c* on the upper surface of the free rocker arm 36. Moreover, openings 53 and 54 are provided in the central portions of the recesses 50 and 51 in the driving rocker arms 34 and 35 to open vertically, and an opening 55 is provided in the central portion of the recess 52 in the free rocker arm 36 to open on a side opposite from the intake-side rocker shaft 37 and upwards.

Rollers 56 and 57 are rotatably carried on the driving rocker arms 34 and 35 and disposed in the openings 53 and 54 to come into rolling contact with the low-speed cams 46, 46, respectively, and a roller 58 is rotatably carried on the free rocker arm 36 and disposed in the opening 55 to come into rolling contact with the high-speed cam 47. Thus, an oil can be accumulated in the recesses 50, 51 and 52 in the rocker arms 34, 35 and 36. Each of the recesses 50, 51 and 52 is defined to be able to guide the oil toward each of the rollers 56, 57 and 58, and passages are provided for smoothly guiding the oil from the recesses 50, 51 and 52 to the rollers 56, 57 and 58, so that the rollers 56, 57 and 58 can be lubricated effectively.

Moreover, the width of each of the low-speed cams 46, 46 in a direction along the axis of the intake-side rocker shaft 37 is set at a value equal to or smaller than a distance between the first and second support walls 34*b*, 34*c* and 35*b*, 35*c* of the driving rocker arms 34 and 35, and the width of the high-speed cam 47 in the direction along the axis of the intake-side rocker shaft 37 is set at a value equal to or smaller than a distance between the first and second support walls 36*b* and 36*c* of the free rocker arm 36. Lower portions of the low-speed cams 46, 46 are accommodated in the recesses 50, 51 with their portions of contact with the rollers 56, 57 being located below the upper ends of the first and second support walls 34*b*, 34*c*; 35*b*, 35*c*. A lower portion of the high-speed cam 47 is accommodated in the recess 52 with its portion of contact with the roller 58 being located below the upper ends of the first and second support walls 36*b* and 36*c*.

The axial width of each of the rollers 56 and 57 in the driving rocker arms 34 and 35 is set smaller than the diameter of the tappet screws 48, 48. This can contribute to a reduction in size of the driving rocker arms 34 and 35 and ensures that the size of the openings 50 and 51 for accommodation of the rollers 56 and 57 can relatively be reduced to contribute to an enhancement in rigidity of the driving rocker arms 34 and 35.

Through-bores 59 and 60 each having an axis parallel to the axis of the intake-side rocker shaft 37 are coaxially provided in the first and second support walls 34*b* and 34*c* of the driving rocker arm 34. A through-bore 61 having an axis parallel to the axis of the intake-side rocker shaft 37 is provided in the first support wall 35*b* of the driving rocker arm 35, and a bottomed bore 62 closed on a side opposite from the free rocker arm 36 is provided coaxially with the through-bore 61 in the second support wall 35*c*. Further, through-bores 63 and 64 each having an axis parallel to the axis of the intake-side rocker shaft 37 are coaxially provided in the first and second support walls 36*b* and 36*c* of the free rocker arm 36.

A cylindrical roller shaft 65 is fixed in the driving rocker arm 34 by press-fitting in the through-bores 59 and 60, and made of a material harder than that of the driving rocker arm 34, i.e., an iron-based material, for example, when the driving rocker arm 34 is made of an aluminum alloy. A cylindrical roller shaft 66 is fixed in the driving rocker arm 35 by press-fitting in the through-bore 61 and the bottomed bore 62, and made of a material having a hardness larger than that of the driving rocker arm 35, i.e., an iron-based material, for example, when the driving rocker arm 35 is made of an aluminum alloy. A cylindrical roller shaft 67 is fixed in the free rocker arm 36 by press-fitting in the through-bores 63 and 64, and made of a material having a hardness larger than that of the free rocker arm 36, i.e., an iron-based material, for example, when the free rocker arm 36 is made of an aluminum alloy.

The roller shafts 65, 66 and 67 are formed into cylindrical shapes with the same inside diameter, and needle bearings 68, 69 and 70 are interposed between the roller shafts 65, 66 and 67 and the rollers 56, 57 and 58, respectively.

Figure 7:
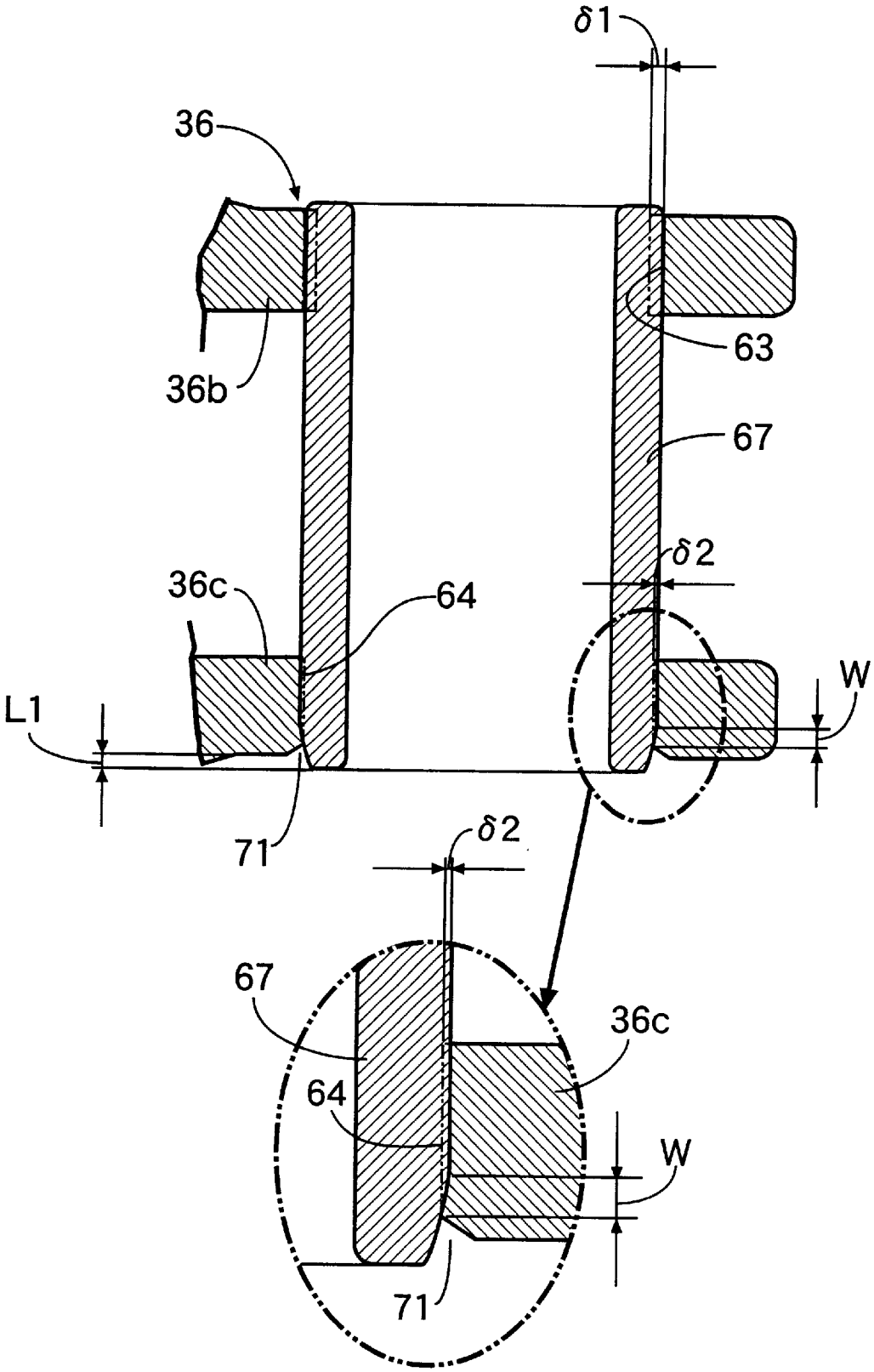

Referring to FIG. 7, in the press-fitting of the roller shaft 67 in the through-bores 63 and 64 in the free rocker arm 36, a press-fit margin δ1 for the roller shaft 67 press-fitted in the through-bore 63 in the first support wall 36*b* is set larger than the maximum value of a press-fit margin δ2 for the roller shaft 67 press-fitted in the through-bore 64 in the second support wall 36*c* of the first and second support walls 36*b* and 36*c*, which is disposed adjacent the driving rocker arm 36. Moreover, the press-fit margin δ2 for the roller shaft 67 press-fitted in the through-bore 64 in the second support wall 36*c* is set larger at an inner end of the through-bore 64, i.e., at a location on the side of the roller 58, than at an outer end of the through-bore 64, i.e., at a location on the side of the driving rocker arm 35. In a region W of the through-bore 64 established on the side of the driving rocker arm 35, the press-fit margin δ2 is set so as to be smaller at an outer location in the through-bore 64, i.e., at a location closer to the driving rocker arm 35. Such a variation in press-fit margin in an axial direction of the through-bore 64 in the second support wall 36*b* is achieved by forming an outer periphery of the end of the roller shaft 67 adjacent the driving rocker arm 35 into an outward bulged curved shape, for example. A tapered chamfer is provided at an outer end edge of the through-bore 64, and an annular clearance 71 is defined between an outer end of the through-bore 64 and the roller shaft 67.

At least one of axially opposite end surfaces of the roller shaft 67 adjacent the driving rocker arm 35 protrudes by an amount L1 from a side surface of the free rocker arm 36 adjacent the driving rocker arm 35.

The roller shaft 65 is press-fitted in the through-bores 59 and 60 in the driving rocker arm 34 in a structure similar to a structure in which the roller shaft 67 is press-fitted in the through-bores 63 and 64 in the free rocker arm 36. At least one of axially opposite end surfaces of the roller shaft 65 adjacent the free rocker arm 36 protrudes by an amount L1 from a side surface of the driving rocker arm 34 adjacent the free rocker arm 36.

Referring carefully to FIG. 6, a lost motion mechanism 72 is provided with the cylinder head 13 below the free rocker arm 36 and operable to apply a spring force to the free rocker arm 36 in a direction to bring the roller 58 of the free rocker arm 36 into rolling contact with the high-speed cam 47. The lost motion mechanism 72 is comprised of a spring 74 which is accommodated in a bottomed slide bore 73 provided in the cylinder head 13 with its upper portion opened and is received at one end thereof in a closed lower end of the slide bore 73, and a lifter 75 connected to the other end of the spring 74.

On the other hand, the free rocker arm 36 has a receiving portion 76 provided in contact with an upper end of the lifter 75 to receive the spring force from the lost motion mechanism 72. The receiving portion 76 is provided at a connection wall 77 connecting lower portions of the tip ends of the first and second support walls 36*b* and 36*c* provided on the free rocker arm 36, so as to substantially correspond to the axially central portion of the roller 58 supported on the free rocker arm 36. In the present embodiment, the free rocker arm 36 is made of a relatively soft aluminum alloy and hence, the receiving portion 76 is formed by securing a member made of a hard material such as an iron-based material to the connection wall 77, and thus, it is possible to reduce the wear of the receiving portion 76, while maintaining the rigidity of the latter. Alternatively, if the free rocker arm 36 is made of a hard material, then the receiving portion 76 may be formed integrally on the connection wall 77. An oil passage 78 is provided in the receiving portion 76 between its inner and outer surfaces.

Moreover, the connection wall 77 extends below the roller 58, and a distance L2 between the tip end of the connection wall 77 and the roller 58 is set smaller than a distance between an intermediate portion of the connection wall 77 and the roller 58. Namely, the connection wall 77 extending below the roller 58 is formed so that the distance between the connection wall 77 and the roller 58 is decreased toward the lowermost portion of the roller 58.

An associative-operation switchover means 80 is provided between the rocker arms 34, 35 and 36 for switching over a state in which the rocker arms 34, 35 and 36 are operated in association with one another and a state in which the associative operation of the rocker arms 34, 35 and 36 is released.

The associative-operation switchover means 80 includes a first switchover pin 81 capable of switching over the associative operation of the driving rocker arm 35 and the free rocker arm 36 adjacent each other, and the releasing of such associative operation, a second cylindrical switchover pin 82 capable of switching over the associative operation of the free rocker arm 36 and the driving rocker arm 34 adjacent each other, and the releasing of such associative operation, a limiting member 83 abut against the second switchover pin 82 on a side opposite from the first switchover pin 81, and a coiled return spring 84 for biasing the limiting member 83 toward the second switchover pin 82. The switchover pins 81 and 82 and the limiting member 83 are made of the same hard material as that for the roller shafts 65, 66 and 67.

The first switchover pin 81 is slidably fitted into the roller shaft 66 of the driving rocker arm 35, and a hydraulic pressure chamber 85 is defined between the closed end of the bottomed bore 62 having the roller shaft 66 press-fitted therein and the first switchover pin 81. An oil passage 86 is provided coaxially, for example, in the intake-side rocker shaft 37 and connected to a hydraulic pressure source through a control valve (not shown), and an annular passage 88 is provided between the driving rocker arm 35 and the intake-side rocker shaft 37 to lead to a communication passage 87 which is provided in the second support wall 35*c* of the driving rocker arm 35 with one end thereof leading to the hydraulic pressure chamber 85. A communication bore 89 is provided in the intake-side rocker shaft 37 to permit the communication between the annular passage 88 and the oil passage 86.

The second switchover pin 82 is slidably received in the roller shaft 67 of the free rocker arm 36, and the first and second switchover pins 81 and 82 are in contact with each other, so that they can be slid on each other.

The limiting member 83 is formed into a bottomed cylindrical shape and slidably received in the roller shaft 65 of the driving rocker arm 34, so that the closed end of the limiting member 83 is in contact with the second switchover pin 82 for sliding movement on each other. A snap ring 90 is mounted to an inner surface of the inner end of the roller shaft 65 to abut against the limiting member 83 for inhibiting the removal of the limiting member 83 from the roller shaft 65.

A snap ring 92 is detachably mounted to an inner surface of the outer end of the roller shaft 65, and a ring-shaped spring-receiving member 91 is inserted into the roller shaft 65 to engage the snap ring 92 from the axial inside, and cannot be closed by the limiting member 83. Moreover, the spring-receiving member 91 is formed into a ring shape from a thin flat plate, which is smaller than the diameter of the return spring 84 and thinner than the thickness of the snap ring 92. The return spring 84 is mounted between the limiting member 83 and the spring-receiving member 91 and accommodated in the roller shaft 65.

In such associative-operation switchover means 80, in a low-speed operational range of the engine, the hydraulic pressure in the hydraulic pressure chamber 85 is relatively low, and contact surfaces of the first and second switchover pins 81 and 82 are at a location corresponding to a location between the driving rocker arm 35 and the free rocker arm 36, while contact surfaces of the second switchover pin 82 and the limiting member 83 are at a location corresponding to a location between the free rocker arm 36 and the driving rocker arm 34. Therefore, the rocker arms 34, 35 and 36 are in relatively swingable states, whereby the intake valves VI, VI are opened and closed with timing and a lift amount depending on the low-speed cams 46, 46.

In a high-speed operational range of the engine, a relatively high hydraulic pressure is applied to the hydraulic pressure chamber 85, whereby the first switchover pin 81 is slidably fitted into the roller shaft 67 of the free rocker arm 36, while urging the second switchover pin 82, and the second switchover pin 82 is slidably fitted into the roller shaft 65 of the driving rocker arm 34, while urging the limiting member 83. Therefore, the rocker arms 34, 35 and 36 are brought into integrally connected states, whereby the intake valves VI, VI are opened and closed with timing and a lift amount depending on the high-speed cam 47.

The operation of the present embodiment will be described below. The rocker arms 34, 35 and 36 in the intake-side valve operating device 30 have swinging support portions 34*a*, 35*a* and 36*a* swingably carried on the intake-side rocker shaft 37, and the first and second support walls 34*b*, 34*c*; 35*b*, 35*c*; 36*b*, 36*c* provided to extend from the swinging support portions 34*a*, 35*a* and 36*a*, respectively, and the recesses 50, 51 and 52 are defined between the support walls 34*b*, 34*c*; 35*b*, 35*c*; 36*b*, 36*c* on the upper surfaces of the rocker arms 34, 35 and 36. Moreover, the rollers 56, 57 and 58 are disposed in the central portions of the recesses 50, 51 and 52 to come into rolling contact with the low-speed cams 46, 46 and the high-speed cam 47 on the intake-side camshaft 38, respectively, and the cams 46, 46 and 47 are partially accommodated in the recesses 50, 51 and 52 to come into contact with the rollers 56, 57 and 58 below the upper ends of the support walls 34*b*, 34*c*; 35*b*, 35*c*; 36*b*, 36*c*.

Therefore, the intake-side camshaft 38 can be disposed in proximity to the rocker arms 34, 35 and 36, and the degree of freedom of the layout of the rocker arms 34, 35 and 36 and the intake-side camshaft 38 can be increased to provide a reduction in size of the entire engine. In addition, the support walls 34*b*, 34*c*; 35*b*, 35*c*; 36*b*, 36*c* on the opposite sides of the recesses 50, 51 and 52 act as reinforcing ribs, thereby enhancing the rigidity of supporting of the swinging support portions 34*a*, 35*a* and 36*a* on the intake-side rocker shaft 37. Moreover, the rollers 56, 57 and 58 can be lubricated by guiding the oil accumulated in the recesses 50, 51 and 52 to the rollers 56, 57 and 58.

It should be noted here that the spring force is applied to the free rocker arm 36 of the rocker arms 34, 35 and 36 capable of being freed relative to the intake valves VI, VI to urge the free rocker arm 36 toward the high-speed cam 47 corresponding to the free rocker arm 36 by the lost motion mechanism 72. The support walls 36*b* and 36*c* of the free rocker arm 36 are interconnected by the connection wall 77, and the receiving portion 76 is provided, in contact with the lifter 75 of the lost motion mechanism 72, on the connecting wall 77 substantially in correspondence to the axially central portion of the roller 58 supported on the free rocker arm 36.

Therefore, a point of a load applied from the high-speed cam 47 to the free rocker arm 36 and a point of the urging force applied from the lost motion mechanism 72 to the free rocker arm 36 cannot be displaced largely in the axial direction of the roller 58, thereby enabling the stable swinging supporting of the free rocker arm 36. In addition, the first and second support walls 36*b* and 36*c* are interconnected by the connection wall 77 and hence, the rigidity of supporting of the roller 58 rotatably supported between the support walls 36*b* and 36*c* can be enhanced.

Moreover, the connection wall 77 is disposed below the roller 58 and formed into the shape such that the distance between the connection wall 77 and the roller 58 is decreased toward the lowermost portion of the roller 58. Therefore, the oil can be retained between the roller 58 and the connection wall 77, thereby lubricating the roller 58 by the oil. Additionally, the oil passage 78 is provided in the receiving portion 76 to extend between the inner and outer surfaces of the receiving portion 76, so that the oil retained between the roller 58 and the connection wall 77 can be guided to contact portions of the lifter 75 of the lost motion mechanism 72 and the receiving portion 76 to contribute to a reduction in wear at the contact portions.

The rollers 56, 57 and 58 in rolling contact with the low-speed cams 46, 46 and the high-speed cam 47 on the intake-side camshaft 38 are rotatably carried on the cylindrical roller shafts 65, 66 and 67 fixed to the rocker arms 34, 35 and 36 with needle bearings 68, 69 and 70 interposed therebetween, respectively. When the associative-operation switchover means 80 is operated from the associative-operation releasing state to the associatively operating state, the first and second switchover pins 81 and 82 of the associative-operation switchover means 80 are slidably fitted into the roller shaft 67 of the free rocker arm 36 and the roller shaft 65 of the driving rocker arm 34, respectively. Namely, the driving rocker arm 35 and the free rocker arm 36 are connected to each other by the first switchover pin 81 located astride between the driving rocker arm 35 and the free rocker arm 36, and the free rocker arm 36 and the driving rocker arm 34 are connected to each other by the second switchover pin 82 located astride between the free rocker arm 36 and the driving rocker arm 34.

The roller shafts 67 and 65 are made of the material harder than those the free rocker arm 36 and the driving rocker arm 34, and at least one of the axially opposite end surfaces of each of the roller shafts 67 and 65 receiving each of the first and second switchover pins 81 and 82 protrudes from each of the rocker arms 36 and 34. More specifically, in the free rocker 36, the end surface of the roller shaft 67 adjacent the driving rocker arm 35 protrudes from the side surface of the free rocker arm 36 toward the driving rocker arm 35, and in the driving rocker arm 34, the end surface of the roller shaft 65 adjacent the free rocker arm 36 protrudes from the side surface of the driving rocker arm 34.

Therefore, even if the hydraulic pressure force in the hydraulic pressure chamber 85 is varied during relatively swinging movements of the adjacent rocker arms 36 and 35; 34 and 36 with the association-operation switchover means 80 brought into the associative-operation releasing state, the end surfaces of the first and second switchover pins 81 and 82 cannot be brought into sliding contact with the side surfaces of the free rocker arm 36 and the driving rocker arm 34, but remain in sliding contact with the end surfaces of the roller shafts 67 and 65. Moreover, the roller shafts 67 and 65 are made of the material harder than that for the free rocker arm 36 and the driving rocker arm 34 and hence, it is possible to prevent the generation of a wear powder due to the sliding contact of the switchover pins 81 and 82 with the roller shafts 67 and 65 to the utmost, so that the wear powder cannot enter into the roller shafts 67 and 65, thereby ensuring the smooth switching-over operation of the switchover pins 81 and 82, i.e., the smooth switching-over operation of the association-operation switchover means 80.

Further, the outer surfaces of the free rocker arm 36 and the driving rocker arm 34 formed of the aluminum alloy have been subjected to the anodizing treatment, and the sliding contact of these rocker arms 36 and 34 with the switchover pins 81 and 82 need not be taken into consideration. Therefore, it is possible to prevent the corrosion of the free rocker arm 36 and the driving rocker arm 34, while retaining a film produced by the anodizing treatment. The driving rocker arm 35 originally has no possibility of being brought into contact with the switchover pins 81 and 82, and even if the driving rocker arm 35 is subjected to the anodizing treatment, the prevention of the corrosion cannot be impeded.

Moreover, each of the roller shafts 65, 66 and 67 is press-fitted into at least one, e.g., both in the embodiment, of the first and second support walls 34*b*, 34*c*; 35*b*, 35*c*; 36*b*, 36*c* included in each of the rocker arms 34, 35 and 36. Therefore, parts other than the roller shafts 65, 66 and 67 are not required for the purpose of fixing the roller shafts 65, 66 and 67, thereby avoiding an increase in number of parts and an increase of processing steps and at the same time, the roller shafts 65, 66 and 67 can be fixed easily to the rocker arms 34, 35 and 36.

A portion of the roller shaft 67 adjacent the second support wall 36*c* in the free rocker arm 36 and a portion of the roller shaft 65 adjacent the second support wall 34*c* in the driving rocker arm 34 are portions receiving the first and second switchover pins 81 and 82 of the associative-operation switchover means 80 from the sides of the driving rocker arm 35 and the free rocker arm 36, and the press-fit margins for the roller shafts 67 and 65 press-fitted into the second support walls 36*c* and 34*c* on the sides of the driving rocker arm 35 and the free rocker arm 36 are set smaller than those for the roller shafts 67 and 65 press-fitted into the second support walls 36*c* and 34*c* on the sides of the rollers 58 and 56.

Therefore, it is possible to suppress the deformation of the ends of the roller shafts 67 and 65 receiving the first and second switchover pins 81 and 82 due to the press-fitting to a small level, and to smoothen press-fitting of the first and second switchover pins 81 and 82 into the roller shafts 67 and 65, thereby smoothening the switching-over between the associative operation of the adjacent rocker arms 35 and 36; 36 and 34 and the releasing of the associative operation by the switchover pins 81 and 82.

Moreover, the press-fit margins for portions of the roller shafts 67 and 65 press-fitted into the second support walls 36*c* and 34*c* in that portion of an press-fit area which is on the sides of the driving rocker arm 35 and the free rocker arm 36 are set so as to be decreased gradually as being closer to the driving rocker arm 35 and the free rocker arm 36. Therefore, the deformation of the ends of the roller shafts 67 and 65 due to the press-fitting is decreased toward the driving rocker arm 35 and the free rocker arm 36 and thus, it is possible to further smoothen the press-fitting of the switchover pins 81 and 82 into the roller shafts 67 and 65 to further smoothen the switching-over between the associative operation and the releasing of the associative operation.

In the present embodiment, the end surface of the roller shaft 67 adjacent the driving rocker arm 35 and the end surface of the roller shaft 65 adjacent the free rocker arm 36 protrude from the free rocker arm 36 and the driving rocker arm 34, and the annular clearances 71 are created between the outer ends of the second support walls 36*c* and 34*c* and the roller shafts 67 and 65. Therefore, it is possible to avoid the application of a stress to the ends of the roller shafts 67 and 65 adjacent the driving rocker arm 35 and the free rocker arm 36 and to further decrease the deformation to further smoothen the switching-over between the associative operation and the releasing of the associative operation by the switchover pins 81 and 82.

Further, the roller shafts 67 and 65 are press-fitted into the first and second support walls 36*b*, 36*c*; 34*b*, 34*c* with the press-fit margin in the first support walls 36*b* and 34*b* larger than the press-fit margin in the second support walls 36*c* and 34*c*. This also makes it possible to suppress the deformation of the ends of the roller shafts 67 and 65 receiving the switchover pins 81 and 82 due to the press-fitting to a small level to smoothen the switching-over between the associative operation and the releasing of the associative operation, and to facilitate the press-fitting operation for the roller shafts 67 and 65 by press-fitting the roller shafts 67 and 65 from the outside of the second support walls 36*c* and 34*c*.

In the driving rocker arm 34 disposed at one end in the direction of arrangement of the rocker arms 34, 35 and 36, the through-bores 59 and 60 are coaxially provided in the first and second support walls 34*b* and 34*c* included in the driving rocker arm 34, so that the opposite ends of the roller shaft 65 are press-fitted into these through-bores, and the ring-shaped spring-receiving member 91 receiving the return spring 84 of the associative-operation switchover means 80 is mounted to the roller shaft 65.

Therefore, as compared with a system in which a bottomed hole must be drilled in the first support wall 34*b*, it is unnecessary to subject the closed end of the bottomed hole to a relieving treatment, and it is possible to facilitate the drilling of the first support wall 34*b*, while enabling a reduction in size of the driving rocker arm 34, and to reduce the weight of the driving rocker arm 34 by an amount corresponding to an end wall which is not required. Moreover, in a case where the intake-side rocker shaft 37 and the roller shaft 65 are parallel to each other as in the present embodiment, a distance between the axes of the intake-side rocker shaft 37 and the roller shaft 65 in the first and second support walls 34*b* and 34*c* can be accurately determined.

Furthermore, the spring-receiving member 91 is inserted into the roller shaft 65 to engage the snap ring 92 detachably mounted to the inner surface of the roller shaft 65 from the axial inside of the rocker shaft 65 and hence, the spring-receiving member 91 is easily mounted to the roller shaft 65 to contribute to the reduction in size of the driving rocker arm 34 without protruding outside from the driving rocker arm 34. In addition, since the spring-receiving member 91 is formed into a ring-shape which cannot be closed by the limiting member 83, the inside of the roller shaft 65 can be visually observed from the outside, and it can be confirmed from the outside whether the return spring 84 is accommodated correctly within the roller shaft 65.

In addition, since the spring-receiving member 91 is formed into the ring shape from the thin flat plate, which is smaller than the diameter of the return spring 84 and thinner than the thickness of the snap ring 92, the weight of the spring-receiving member 91 can be reduced to contribute to a reduction in weight of the entire driving rocker arm 34.

Further, the amount of deformation of the inner surface of the roller shaft 65 at a place of mounting of the snap ring 92 on the inner surface of the roller shaft 65 can be reduced by press-fitting the roller shaft 65 into the through-bore 59 in the first support wall 34*b*, as compared with a case where the roller shaft 65 is fixed in a caulked manner to the first support wall 34*b*, thereby enhancing the mountability of the snap ring 92 to the roller shaft 65.

In an alternative embodiment of the present invention, a bolt or a blind plug can be used in place of the ring-shaped spring-receiving member 91.

Figure 8:
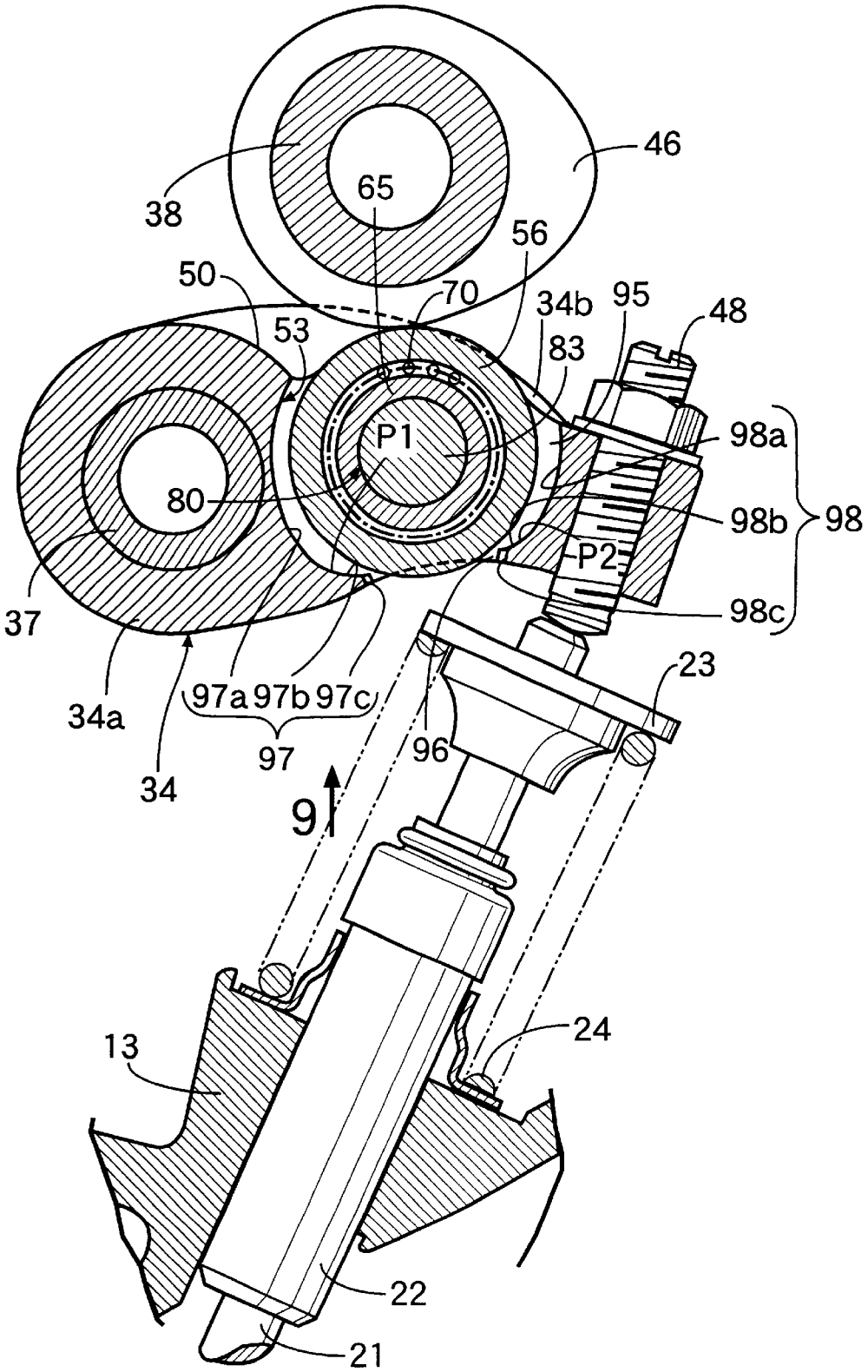
FIG. 8 is a sectional view similar to FIG. 4, but according to a second embodiment of the present invention.
Figure 9:
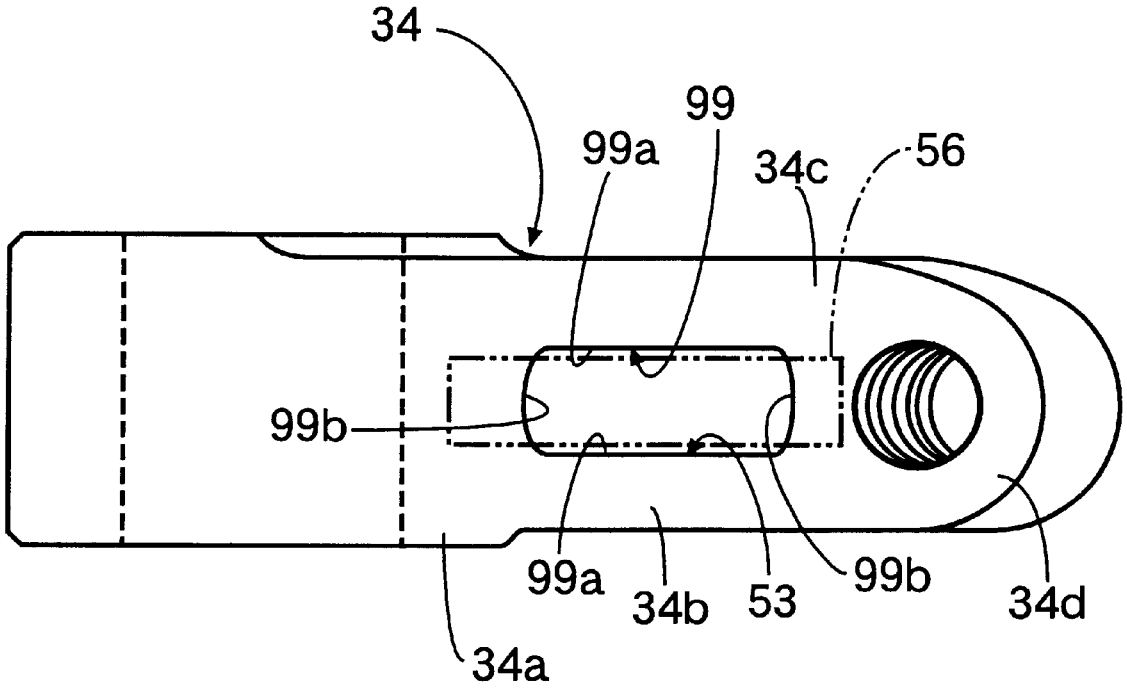
FIG. 9 is a view taken in the direction of an arrow 9 in FIG. 8.

FIGS. 8 and 9 show a second embodiment of the present invention, wherein portions or components corresponding to those in the first embodiment are designated by like reference characters.

A roller-accommodating bore 53 in the driving rocker arm 34 has a pair of surfaces 97 and 98 opposed to the outer peripheral surface of the roller 56, and is formed so that the area of an opening at its lower end is smaller than that at its upper end. Each of the opposed surfaces 97 and 98 is comprised of a curved surface portion 97*a*, 98*a* curved into a circle concentric with the roller 56, and an extended surface portion 97*b*, 98*b* connected at one end thereof to a lower end of the curved surface portion 97*a*, 98*a*, and a lower surface portion 97*c*, 98*c* connected to the other end of the extended surface portion 97*b*, 98*b*.

The curved surface portions 97*a* and 98*a* are formed to extend between the upper surface of the driving rocker arm 34 and preset points P1 and P2 spaced upwards apart from the lower surfaces of the driving rocker arms 34 and 35, and are formed into a circularly curved shape concentric with the roller 56. Each of the extended surface portions 97*b* and 98*b* extends toward the outer peripheral surface of the roller 56, and is connected at one end thereof to the lower end of the corresponding curved surface portion 97*a*, 98*a*. Each of the extended surface portions 97*b* and 98*b* is formed so as to be curved, for example, with a radius of curvature smaller than that of the curved surface portion 97*a*, 98*a*; and is smoothly connected to the lower end of the curved surface portion 97*a*, 98*a*. Further, the lower surface portions 97*c* and 98*c* are formed so as to interconnect the other ends of the extended surface portions 97*b* and 98*b* and the lower surface of the driving rocker arm 34, and to be opposed to the lower portion of the outer peripheral surface of the roller 56.

An opening edge 99 at the lower end of the roller-accommodating bore 53 is comprised of a pair of parallel portions 99*a*, 99*a* parallel to each other and corresponding to the opposite side surfaces of the roller 56, and a pair of curved portions 99*b*, 99*b* opposed to the outer peripheral surface of the lower portion of the roller 56 and interconnecting the parallel portions 99*a*, 99*a*. The curved portions 99*b*, 99*b* are formed so as to be bulged and curved on a side opposite from the outer peripheral surface of the lower portion of the roller 56. Moreover, each of the curved portions 99*b*, 99*b* is formed as a portion connecting the lower end of each of the lower surface portions 97*c* and 98*c* and the lower surface of the driving rocker arm 34 to each other. The lower surface portions 97*c* and 98*c* are also formed into curved shapes, as are the curved portions 99*b*, 99*b*, and the curved portions 99*b*, 99*b* are smoothly connected at their opposite ends to the parallel portions 99*a*, 99*a*, respectively.

The roller-accommodating bore 54 (see the first embodiment) in the driving rocker arm 35 is also formed, as is the roller-accommodating bore 53 in the driving rocker arm 34.

According to the second embodiment, in each of the roller-accommodating bores 53 and 54 provided in the driving rocker arms 34 and 35, each of the surfaces 97 and 98 opposed to the outer peripheral surfaces of the rollers 56 and 57 is comprised of the curved surface portion 97*a*, 98*a* which is formed to extend between the upper surface of the driving rocker arm 34, 35 and the each of the preset points P1 and P2 spaced upwards apart from the lower surfaces of the driving rocker arms 34 and 35 and is curved into a circular shape concentric with the roller 56, 57, the extended surface portion 97*b*, 98*b* connected at one end thereof to the lower end of the curved surface portion 97*a*, 98*a* and extending toward the outer peripheral surface of the roller 56, 57, and the lower surface portion 97*c*, 98*c* which interconnects the other end of the extended surface portion 97*b*, 98*b* and the lower surface of the driving rocker arm 34, 35 and is opposed to the lower portion of the outer peripheral surface of the roller 56, 57.

Therefore, by provision of the extended surface portions 97*b* and 98*b* and the lower surface portions 97*c* and 98*c* of the surfaces 97 and 98 provided in the roller-accommodating bores 53 and 54, the thickness of each of the driving rocker arms 34 and 35 at locations corresponding to the lower portions of the roller-accommodating bores 53 and 54 can be ensured at such a level that a reduction in rigidity can be prevented. Moreover, by forming the extended surface portions 97*b* and 98*b* to extend from the lower ends of the curved surface portions 97*a* and 98*a* toward the outer peripheral surfaces of the rollers 56 and 57, the lower portions of the surfaces 97 and 98 can be disposed at locations closer to the rollers 56 and 57 to reduce the areas of the openings of the lower ends of the roller-accommodating bores 53 and 54, thereby enhancing the ability to retain the oil between the surfaces 97 and 98 of the roller-accommodating bores 53 and 54 and the rollers 56 and 57, as compared with a case where the surfaces are formed at the same radius of curvature between the upper and lower surfaces of the driving rocker arms 34 and 35.

Moreover, the opening edge 99 at each of the lower ends of the roller-accommodating bores 53 and 54 is comprised of the pair of the parallel portions 99*a*, 99*a* parallel to each other and corresponding to the opposite side surfaces of the rollers 56 and 57, and the pair of curved portions 99*b*, 99*b* which interconnect the parallel portions 99*a*, 99*a* opposing to the outer peripheral surfaces of the lower portions of the rollers 56 and 57 and which are bulged on the side opposite from the outer peripheral surfaces of the lower portions of the rollers 56 and 57, and the opposite ends of the curved portions 99*b*, 99*b* are smoothly connected to the parallel portions 99*a*, 99*a*. Therefore, it is possible to avoid that a stress-concentrated portion is created at the opening edge at the lower end of each of the roller-accommodating bores 53 and 54, thereby contributing to an enhancement in durability.

In the second embodiment, the extended surface portions 97*b* and 98*b* are formed so as to be curved with the radius of curvature smaller than those of the curved surface portions 97*a* and 98*a*, but if they are formed to extend from the lower ends of the curved surface portions 97*a* and 98*a* toward the outer peripheral surfaces of the rollers 56 and 57, they need not be curved.

Figure 10:
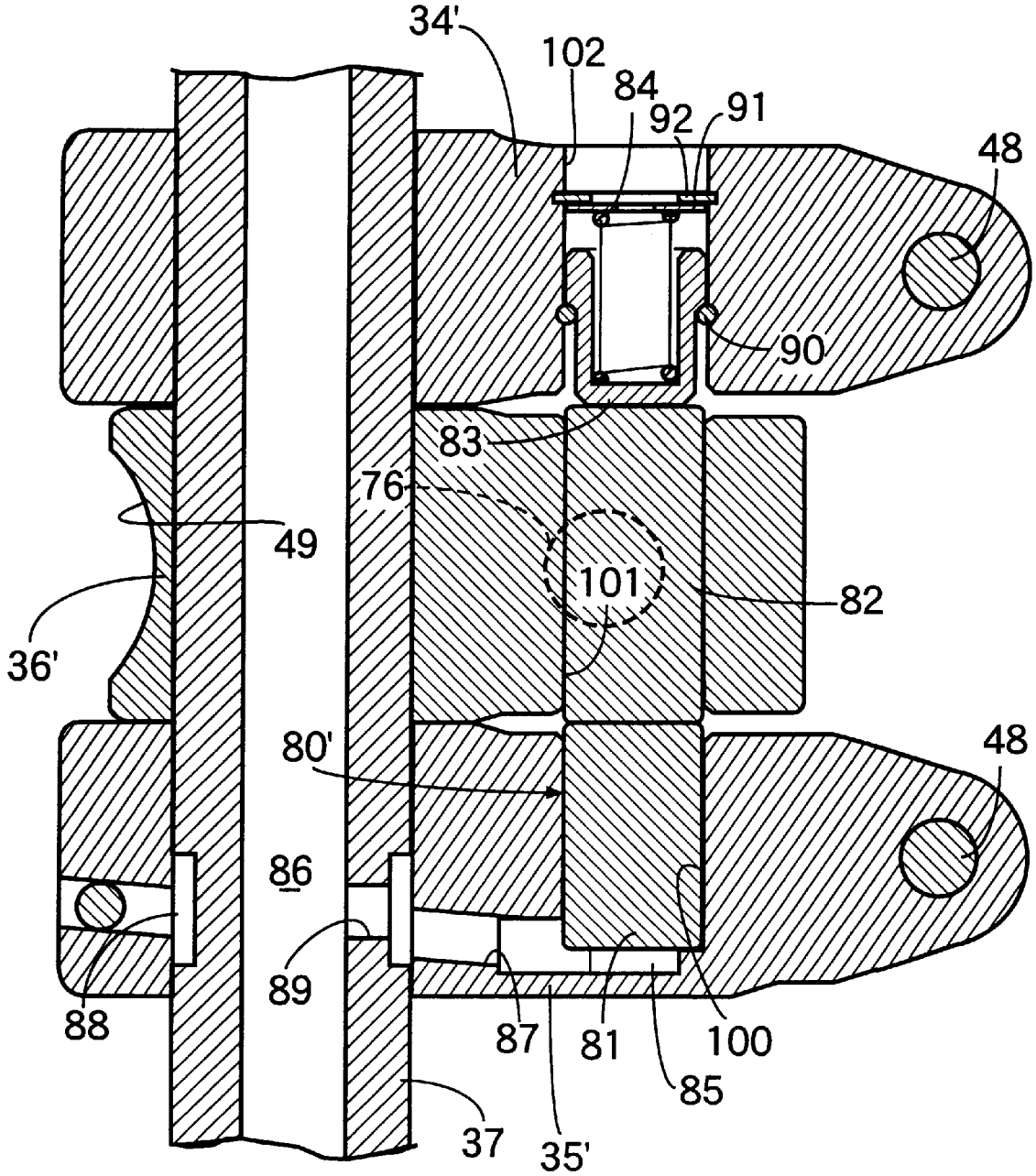
FIG. 10 is a sectional view similar to FIG. 5, but according to a third embodiment of the present invention.

FIG. 10 shows a third embodiment of the present invention, wherein portions or components corresponding to those in the first and second embodiments are designated by like reference characters.

A driving rocker arm 34' which is a first rocker arm, a driving rocker arm 35' and a free rocker arm 36' which is a second rocker arm are disposed adjacent one another and swingably supported commonly on a rocker shaft 37 in such a manner that the free rocker arm 36' is sandwiched between the driving rocker arms 34' and 35'. Tappet screws 48, 48 are threadedly fitted in the driving rocker arms 34' and 35' to abut against intake or exhaust valves (not shown), respectively.

An associative-operation switchover means 80' is provided between the rocker arms 34', 35' and 36' for switching over a state in which the rocker arms 34', 35' and 36' are operated in association to one another and a state in which the associative operation of the rocker arms 34', 35' and 36' is released.

The associative-operation switchover means 80' includes a first switchover pin 81 capable of switching over the associative operation of the driving rocker arm 35' and the free rocker arm 36' disposed adjacent each other and the releasing of the associative operation, a second cylindrical switchover pin 82 capable of switching over the associative operation of the free rocker arm 36' and the driving rocker arm 34' disposed adjacent each other and the releasing of the associative operation, a limiting member 83 for abutting against the second switchover pin 82 on an opposite side from the first switchover pin 81, and a coiled return spring 84 for biasing the limiting member 83 toward the second switchover pin 82.

A bottomed hole 100 is provided in the driving rocker arm 35 in parallel to the rocker shaft 37 and opens toward the free rocker arm 36', and the first switchover pin 81 is slidably received in the bottomed hole 100. Moreover, a hydraulic pressure chamber 85 is defined between a closed end of the bottomed hole 100 and the first switchover pin 81, and an annular passage 88 is provided between the driving rocker arm 35' and the rocker shaft 37 to lead to a communication passage 87 provided in the driving rocker arm 35' with one end leading to the hydraulic pressure chamber 85. A communication bore 89 is provided in the rocker shaft 37 for permitting an oil passage 86 in the rocker shaft 37 and the annular passage 88 to communicate with each other.

A through-bore 101 with opposite ends opened is provided in the free rocker arm 36' in parallel to the rocker shaft 37. The second switchover pin 82 is slidably received in the through bore 101, and the first and second switchover pins 81 and 82 are brought into sliding contact with each other.

A through-bore 102 with opposite ends opened is provided in the driving rocker arm 34' in parallel to the rocker shaft 37. The bottomed cylindrical limiting member 83 is slidably received in the through-bore 102, and the closed end of the limiting member 83 is brought into sliding contact with the second switchover pin 82.

Moreover, the through-bores 101 and 102 are formed to have straight inner surface shapes without a step formed therebetween.

A retaining ring 90 is mounted to an inner surface of an inner end of the through-bore 102 to abut against the limiting member 83 for inhibiting the removal of the limiting member 83 from the roller shaft 65. A snap ring 92 is also detachably mounted to an inner surface of an outer end of the through-bore 102, and a ring-shaped spring-receiving member 91 which cannot be closed by the limiting member 83 is inserted into the through-bore 102 so as to be brought into engagement with the snap ring 92 from the axial inside. Moreover, the spring-receiving member 91 is formed into a ring-shape from a flat plate smaller than the diameter of the return spring 84 and thinner than the thickness of the snap ring 92. The return spring 84 is mounted between the limiting member 83 and the spring-receiving member 91 and is accommodated in the through-bore 102.

In the third embodiment, the snap ring 92 is detachably mounted to the inner surface of the outer end of the through-bore 102 to engage the outer surface of the ring-shaped spring-receiving member 91 inserted in the through-bore 102. Therefore, as compared with the prior art system in which the bottomed hole must be provided by drilling, a relieving treatment is not required, whereby the drilling of the driving rocker arm 34' can be facilitated, while enabling a reduction in size of the driving rocker arm 34' and moreover, the weight of the driving rocker arm 34' can be reduced by an amount corresponding to the unnecessary end wall.

In addition, it is easy to mount the spring-receiving member 91 to the driving rocker arm 34' and further, the spring-receiving member 91 can be formed thinner than the snap ring 92, whereby the weight of the spring-receiving member 91 can be reduced to contribute to a reduction in weight of the entire driving rocker arm 34'. Moreover, it can be ascertained from the outside through the ring-shaped spring-receiving member 91 whether the return spring 84 has been accommodated correctly in the through-bore 102.

Further, the through-bore 102 has a straight inner surface shape with its diameter constant over the entire length and hence, it is extremely easy to make the through-bore 102 by drilling, and it is possible to facilitate the assembling of the limiting member 83, the return spring 84, the retaining ring 90, the spring-receiving member 91 and the snap ring 92 to the driving rocker arm 34'.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating system in an internal combustion engine, comprising a first rocker arm having a pair of support walls which support a cylindrical roller shaft at opposite ends thereof, said roller shaft rotatably carrying a roller mounted in rolling contact with a cam provided on a camshaft, said support walls being disposed on opposite sides of said roller, a second rocker arm disposed adjacent said first rocker arm, and an associative-operation switchover means including a switchover pin which is movable between an associatively operating position where said first and second rocker arms are operated in association with each other and an associative-operation releasing position where said switchover pin is separated from said first rocker arm to release the associative operation, said switchover pin being capable of transmitting a hydraulic pressure force acting toward said associatively operating position, a limiting member which is slidably received in said roller shaft in said first rocker arm to abut against said switchover pin, and a coiled return spring accommodated in said roller shaft to exhibit a spring force for biasing said switchover pin toward said associative-operation releasing position, said associative-operation switchover means being provided between a plurality of rocker arms including said first and second rocker arms, wherein said support walls have through-bores coaxially provided therein, in which opposite ends of said roller shaft are fitted and fixed, and a spring-receiving member is mounted to said roller shaft for receiving said return spring which is interposed between said spring-receiving member and said limiting member, and wherein a snap ring is detachably mounted to a groove formed in an inner surface of said roller shaft, said groove being provided in an area of said roller shaft which is fitted and fixed to said rocker arm, and said spring-receiving member is engaged with said snap ring from an axial inner side of said roller shaft.

2. A valve operating system in an internal combustion engine according to claim 1, in which said spring-receiving member is thinner than said snap ring and located radially inside said snap ring.

3. A valve operating system in an internal combustion engine according to claim 1, wherein a driving rocker arm included in said plurality of rocker arms and operatively connected to an engine valve has a roller-accommodating bore provided therein to open vertically, said roller-accommodating bore having a pair of surfaces opposed to an outer peripheral surface of said roller mounted in rolling contact with the cam, said roller being accommodated in said roller-accommodating bore, said roller-accommodating bore being formed to have an area of an opening at a lower end thereof smaller than that at an upper end thereof, with each of said opposed surfaces being comprised of a curved surface portion which is formed to extend between an upper surface of said driving rocker arm and a preset point spaced upwards from a lower surface of said driving rocker arm, said curved surface portion being curved into a circular shape concentric with said roller, an extended surface portion connected at one end thereof to a lower end of said curved surface portion and extending toward the outer peripheral surface of said roller, and a lower surface portion which interconnects the other end of said extended surface portion and the lower surface of said rocker arm and is opposed to a lower portion of the outer peripheral surface of said roller.

4. A valve operating system in an internal combustion engine according to claim 1, wherein a driving rocker arm included in said plurality of rocker arms and operatively connected to an engine valve has a roller-accommodating bore provided therein to open vertically, said roller-accommodating bore having a pair of surfaces opposed to an outer peripheral surface of said roller mounted in rolling contact with the cam, said roller being accommodated in said roller-accommodating bore, an opening edge at the lower end of said roller-accommodating bore being comprised of a pair of parallel portions parallel to each other and corresponding to the opposite side surfaces of said roller, and a pair of curved portions which are opposed to the outer peripheral surface of the lower portion of said roller and interconnect said parallel portions, said curved portions being bulged on a side opposite from the outer peripheral surface of the lower portion of said roller, opposite ends of said curved portions being smoothly connected to said parallel portions.

5. A valve operating system in an internal combustion engine, comprising a first rocker arm having a pair of support walls which support a cylindrical roller shaft at opposite ends thereof, said roller shaft rotatably carrying a roller mounted in rolling contact with a cam provided on a camshaft, said support walls being disposed on opposite sides of said roller, a second rocker arm disposed adjacent said first rocker arm, and an associative-operation switchover means including a switchover pin which is movable between an associatively operating position where said first and second rocker arms are operated in association with each other and an associative-operation releasing position where said switchover pin is separated from said first rocker arm to release the associative operation, said switchover pin being capable of transmitting a hydraulic pressure force acting toward said associatively operating position, a limiting member which is slidably received in said roller shaft in said first rocker arm to abut against said switchover pin, and a coiled return spring accommodated in said roller shaft to exhibit a spring force for biasing said switchover pin toward said associative-operation releasing position, said associative-operation switchover means being provided between a plurality of rocker arms including said first and second rocker arms, wherein said support walls have through-bores coaxially provided therein, in which opposite ends of said roller shaft are fitted and fixed, and a spring-receiving member is mounted to said roller shaft for receiving said return spring which is interposed between said spring-receiving member and said limiting member, and wherein a snap ring is detachably mounted to a groove formed in an inner surface of said roller shaft, said groove being provided substantially axially centrally in an area of said roller shaft which is fitted and fixed to one of said pair of support walls of said rocker arm, and said spring-receiving member is engaged with said snap ring from an axial inner side of said roller shaft.

6. A valve operating system in an internal combustion engine, comprising a first rocker arm having a pair of support walls which support a cylindrical roller shaft at opposite ends thereof, said roller shaft rotatably carrying a roller mounted in rolling contact with a cam provided on a camshaft, said support walls being disposed on opposite sides of said roller, a second rocker arm disposed adjacent said first rocker arm, and an associative-operation switchover means including a switchover pin which is movable between an associatively operating position where said first and second rocker arms are operated in association with each other and an associative-operation releasing position where said switchover pin is separated from said first rocker arm to release the associative operation, said switchover pin being capable of transmitting a hydraulic pressure force acting toward said associatively operating position, a limiting member which is slidably received in said roller shaft in said first rocker arm to abut against said switchover pin, and a coiled return spring accommodated in said roller shaft to exhibit a spring force for biasing said switchover pin toward said associative-operation releasing position, said associative-operation switchover means being provided between a plurality of rocker arms including said first and second rocker arms, wherein said support walls have through-bores coaxially provided therein, in which opposite ends of said roller shaft are fitted and fixed, and a spring-receiving member is mounted to said roller shaft for receiving said return spring which is interposed between said spring-receiving member and said limiting member, and wherein a snap ring is detachably mounted to a groove formed in an inner surface of said roller shaft, said groove being provided in an area of said roller shaft corresponding to one of said pair of support walls of said rocker arm, a bore for receiving said roller shaft is formed through said one support wall and an end wall formed on said one support wall defining an axial end of said bore is connected in a substantially coplanar manner to an axially outer end surface of said one support wall so as to be located axially outside said groove, and said spring-receiving member is engaged with said snap ring from an axial inner side of said roller shaft.

7. A valve operating system in an internal combustion engine according to claim 5, wherein said spring-receiving member is located radially inside said snap ring and thinner than said snap ring.

8. A valve operating system in an internal combustion engine according to claim 6, wherein an axial end of said roller shaft on the side where the other of said pair of support walls is provided is located further axially inwardly than an end surface of said other support wall.

9. A valve operating system in an internal combustion engine according to claim 5, wherein an axial end of said roller shaft on the side where the other of said pair of support walls is provided is located further axially inwardly than an end surface of said other support wall.

10. A valve operating system in an internal combustion engine according to claim 6, wherein said spring-receiving member is located radially inside said snap ring and thinner than said snap ring.

* * * * *